US009744418B2

(12) United States Patent
Kauffman

(10) Patent No.: US 9,744,418 B2
(45) Date of Patent: Aug. 29, 2017

(54) PNEUMATIC BALL-SUSPENDING DEVICE

(71) Applicant: Robert David Kauffman, Mokena, IL (US)

(72) Inventor: Robert David Kauffman, Mokena, IL (US)

( * ) Notice: Subject to any disclaimer, the term of this patent is extended or adjusted under 35 U.S.C. 154(b) by 0 days.

(21) Appl. No.: 15/000,230

(22) Filed: Jan. 19, 2016

(65) Prior Publication Data

US 2017/0203175 A1 Jul. 20, 2017

(51) Int. Cl.
*A63B 71/00* (2006.01)
*A63B 69/00* (2006.01)

(52) U.S. Cl.
CPC .. *A63B 69/0002* (2013.01); *A63B 2069/0008* (2013.01); *A63B 2208/0204* (2013.01)

(58) Field of Classification Search
CPC ..... A63B 69/0002; A63B 2069/0008; A63B 2208/0204
USPC ..... 473/418, 451, 431, 422; 124/56, 75; 446/179; 40/407
See application file for complete search history.

(56) References Cited

U.S. PATENT DOCUMENTS 1,744,680 A * 1/1930 Sherrill ..... G09F 11/23 40/407
3,050,146 A * 8/1962 Crim ..... B60V 1/02 446/179
3,883,138 A 5/1975 Chorey
4,045,906 A 9/1977 Goldfarb et al.
4,136,869 A 1/1979 Tassone
4,211,412 A * 7/1980 Barlow ..... A63F 9/0079 273/356
4,345,765 A * 8/1982 Wang ..... F41J 9/02 273/359
4,564,195 A 1/1986 McClure et al.
4,575,080 A 3/1986 Miles
4,946,164 A 8/1990 Fuller et al.
5,011,144 A 4/1991 Marello et al.
5,145,176 A 9/1992 Lipson
5,794,364 A * 8/1998 Richmond ..... G09F 19/02 40/406
6,186,857 B1 * 2/2001 Gazit ..... G09F 15/0025 40/406
7,294,071 B1 11/2007 Saumell
7,846,045 B1 12/2010 Kendall
8,246,492 B2 8/2012 Gangelhoff
9,114,297 B1 * 8/2015 Saumell ..... A63B 69/0002 473/418
D739,468 S * 9/2015 Champ ..... D21/302
(Continued)

*Primary Examiner* — Mitra Aryanpour
(74) *Attorney, Agent, or Firm* — Quarles & Brady LLP

(57) ABSTRACT

A pneumatic ball-suspending device includes a base, a conduit extending from the base, a source of pressurized air disposed within the base and in fluid communication with the conduit, and a cap formed at an end of the conduit. The cap includes a face that is generally perpendicular to a longitudinal axis of the conduit and at least three channels formed through the cap, each channel having a longitudinal axis formed through a center of a respective channel, wherein the longitudinal axis of each channel defines an airflow path and wherein the longitudinal axis of at least one of the channels is angled with respect to at least one of an x-, y-, or z-axis. The source of pressurized air forces air through the conduit and through the channels, such that any escaping air follows at least one of the air flow paths.

17 Claims, 6 Drawing Sheets

(56) References Cited

U.S. PATENT DOCUMENTS

| | | | | |
|---|---|---|---|---|
| 9,273,936 | B2 * | 3/2016 | Jackson | F41J 3/0004 273/359 |
| 2002/0198068 | A1 * | 12/2002 | Jordan | A63B 69/0002 473/418 |
| 2007/0238554 | A1 | 10/2007 | Hu | |
| 2008/0009373 | A1 * | 1/2008 | Binder | A63B 69/409 473/418 |
| 2012/0004054 | A1 * | 1/2012 | McKendrick | A63B 69/0075 473/418 |

* cited by examiner

PNEUMATIC BALL-SUSPENDING DEVICE

BACKGROUND

The present invention relates generally to an apparatus for suspending a ball and, more particularly, to a pneumatic ball-suspending device.

Various devices have been developed for supporting and/or suspending a ball (e.g., baseball, softball, etc.). For example, tees are utilized for your children, wherein the tees include a flat base, a hollow conduit extending upwardly from the base, and a cup-shaped member for holding a ball thereon. A user places a ball on the cup-shaped member and hits the ball off of the tee. These devices are suitable for small children, but not necessarily for adults.

Ball-supporting devices have, therefore, been developed which utilize an upward stream of air from an air blower. The ball-supporting devices includes a base, a conduit for directing air, and an air source in communication with the conduit. The air source is utilized to suspend the ball in place over the conduit to prevent hitting of the conduit and to provide movement to the ball. Such ball-supporting devices do not prevent extreme left to right, front to back, or up and down movements. It is therefore desirable to have a ball-supporting device that provides a more stable support of a ball above the conduit.

DETAILED DESCRIPTION OF DRAWINGS

Figure 1:
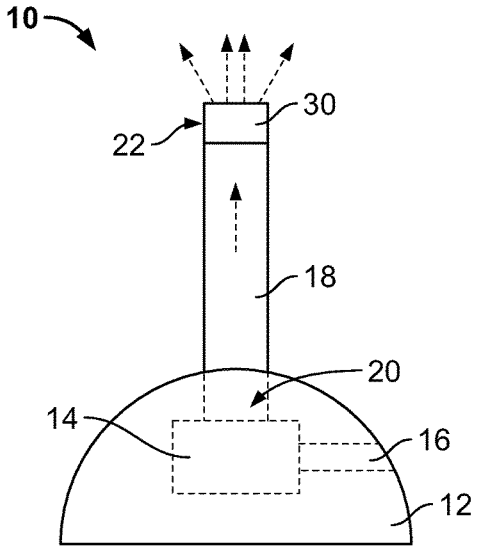
FIG. 1 is a diagram of a pneumatic ball-suspending device in accordance with an exemplary embodiment of the present disclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

The present disclosure is directed to a pneumatic ball-suspending device. While the apparatus of the present disclosure may be embodied in many different forms, several specific embodiments are discussed herein with the understanding that the present disclosure is to be considered only as an exemplification of the principles of the disclosure, and it is not intended to limit the disclosure to the embodiments illustrated. Referring to FIG. 1, a pneumatic ball-suspending device 10 includes a base 12 that houses a motor 14. The motor 14 draws in ambient air through an air intake channel or conduit 16 and expels air through a hollow conduit 18, which includes a first end 20 adjacent or within the base 12 and a second end 22 spaced from the base 12. While a motor 14 is depicted as moving air into the base 12 and through the hollow conduit 18, any other suitable means for moving air may be utilized without departing from the scope of the present disclosure. In an exemplary embodiment, the hollow conduit 18 may have a diameter, width, or other dimension that varies from the first end 20 to the second end 22. A cap 30 may be disposed at the second end 22 of the hollow conduit 18. The cap 30 directs the air in a number of desired direction or directions, as will be discussed in greater detail below.

Figure 2A:
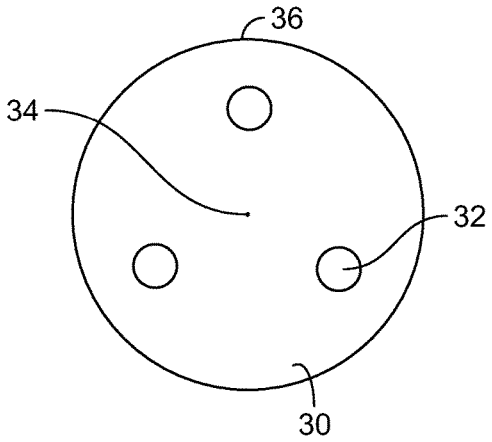
FIG. 2A illustrates a top view of an exemplary embodiment of a cap for attachment to a top portion of a hollow conduit of the ball-suspending device of FIG. 1, wherein the cap is depicted as having three channels.
Figure 2B:
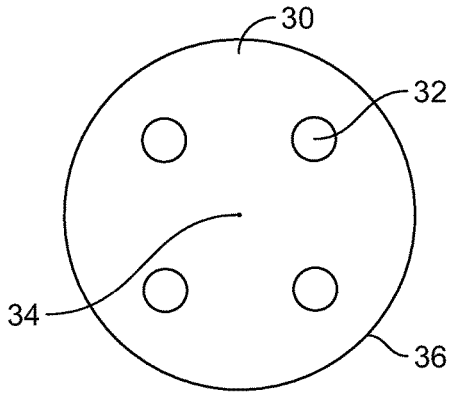
FIG. 2B illustrates a top view of an exemplary embodiment of a cap similar to the cap of FIG. 2A and which includes four channels.
Figure 2C:
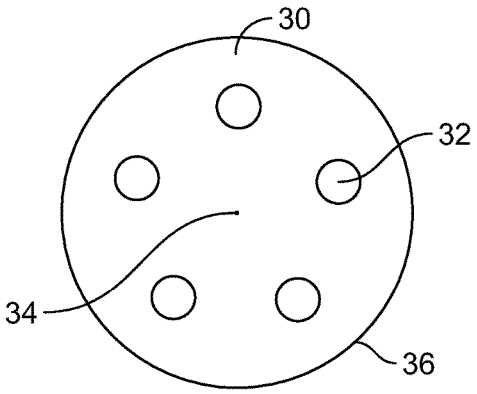
FIG. 2C illustrates a top view of an exemplary embodiment of the cap of FIG. 2A and which includes five channels.
Figure 2D:
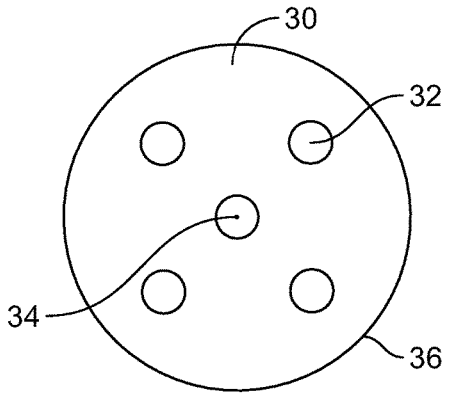
FIG. 2D illustrates a top view of an exemplary embodiment of the cap of FIG. 2A having five channels in an arrangement different than the arrangement shown FIG. 2C.

As depicted in FIGS. 2A-2D, the cap 30 may include any suitable number of channels 32, for example, three channels 32 as seen in FIG. 2A, four channels 32 as seen in FIG. 2B, and five channels 32 as seen in FIGS. 2C and 2D. Likewise, the channels 32 may be positioned at any suitable locations. For example, the five channels 32 of FIG. 2C are depicted as being located equidistant from a center 34 of the cap 30. In another embodiment having five channels 32, as depicted in FIG. 2D, four of the channels 32 may be located near an edge 36 of the cap 30 and one of the channels 32 may be located at the center 34 of the cap 30.

While the cap 30 is depicted as a separate piece with the channels 32 formed therethrough, the second end 22 of the hollow conduit 18 may alternatively be formed with an integral closure having the channels 32 disposed therethrough. Separate and integral caps have their own advantages, for example, a separate cap would allow for interchangeable caps and an integral cap would eliminate any movement of the cap.

In an exemplary embodiment the cap 30 may include at least three channels 32 that are formed at angles different from one another. In the embodiment depicted in FIGS. 3A-3C, the cap 30 includes channels 32*a*-32*d*, all which are formed at angles such that the direction of air passing through the channels 32*a*-32*d* is directed in air flow directions A-D respectively.

In some embodiments, each of the channels 32*a*-32*d* is formed at a specific distance from the opposing channel 32*a*-32*d* (e.g., channel 32*a* opposes channel 32*c* and channel 32*b* opposes channel 32*d*). In some embodiments, this distance may be one-half inch, one inch, two inches, or even four inches, measured from a center point 35 of one of the channels 32*a*-32*d* to a center point 35 of an opposing channel 32*a*-32*d* (i.e., channels 32*a*, 32*c* are opposing and channels 32*b*, 32*d* are opposing). In some embodiments, this distance between one pair of opposing channels 32*a*-32*d* (e.g., channels 32*a* and 32*c*) is the same as the distance between the other pair of opposing channels 32*a*-32*d* (e.g., channels 32*b* and 32*d*). In other embodiments, these distances are not the same.

Figure 3A:
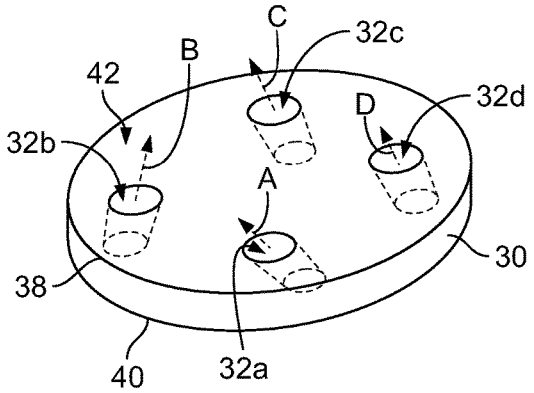
FIG. 3A illustrates a perspective view of an exemplary embodiment of the cap of FIG. 2A having four channels.
Figure 3B:
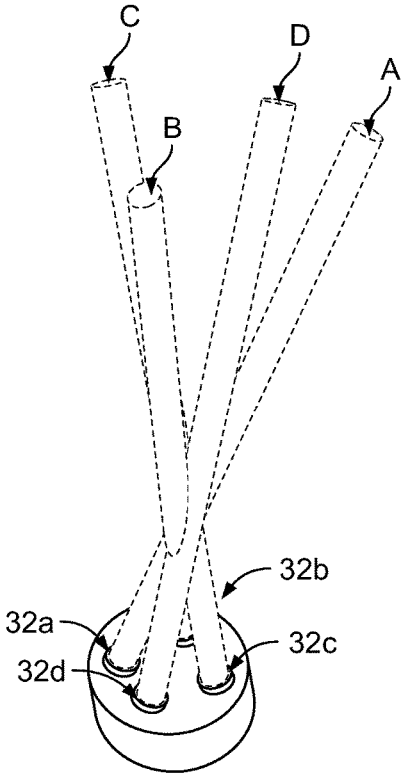
FIG. 3B is a perspective view of the cap shown in FIG. 3A and which additionally depicts resultant air flow directions of the channels.
Figure 3C:
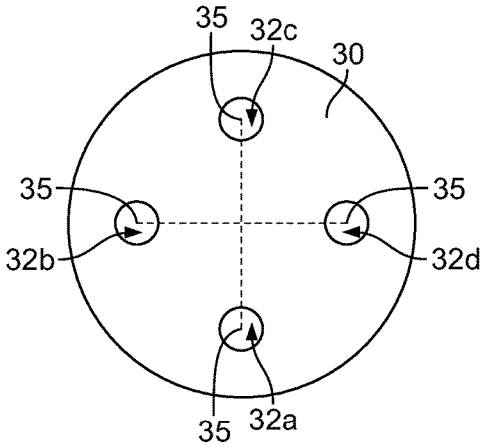
FIG. 3C is a top elevational view of the cap shown in FIG. 3A.

In an exemplary embodiment, one or more of the channels 32*a*-*d* formed through the cap 30 shown in FIGS. 3A-3C may be formed at specific angles with respect to at least one axis of a Cartesian coordinate system, as depicted in FIGS. 3A and 3B. In other embodiments, one or more of the channels 32*a*-32*d* formed through the cap may be formed at specific angles with respect to at least two axes of the Cartesian coordinate system or all three axes of the Cartesian coordinate system.

Figure 4A:
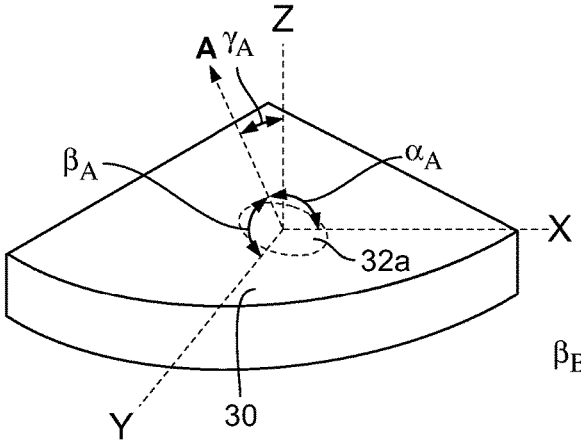
FIG. 4A illustrates an enlarged perspective view of a first channel (A) in an exemplary embodiment of the cap of FIG. 3A.

In one exemplary embodiment, as shown in FIG. 4A, the channel 32*a* and its resultant airflow A may be formed at an angle $\alpha_A$ of between about 70 and about 105 degrees with respect to the x-axis or at an angle $\alpha_A$ of about 92 degrees with respect to the x-axis. All angles herein are measured between the air flow direction and the positive x-, y-, or z-axis, consistent with the axes depicted in FIG. 3A. The channel 32*a* and its resultant airflow A may additionally or alternatively be formed at an angle $\beta_A$ of between about 65 and about 95 degrees with respect to the y-axis or at an angle $\beta_A$ of about 78 degrees with respect to the y-axis. Still further, the channel 32*a* and its resultant airflow A may alternatively or additionally be formed at an angle $\gamma_A$ of between about 1 and about 20 degrees with respect to the z-axis or at an angle $\gamma_A$ of about 12 degrees with respect to the z-axis, as shown in FIG. 4A.

Figure 4B:
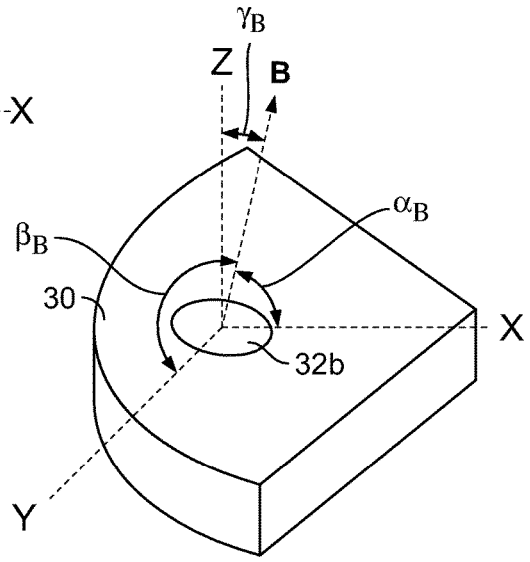
FIG. 4B illustrates an enlarged perspective view of a second channel (B) in an exemplary embodiment of the cap of FIG. 3A.

Referring to FIG. 4B, the channel 32*b* may be formed at an angle $\alpha_B$ of between about 60 and about 90 degrees with respect to the x-axis or at an angle $\alpha_B$ of about 79 degrees with respect to the x-axis. The channel 32*b* and its resultant airflow B may additionally or alternatively be formed at an angle $\beta_B$ of between about 75 and about 100 degrees with respect to the y-axis or at an angle $\beta_B$ of about 89 degrees with respect to the y-axis. Still further, the channel 32*b* and its resultant airflow may be formed at an angle $\gamma_B$ of between about 1 and about 20 degrees with respect to the z-axis or at an angle $\gamma_B$ of about 11 degrees with respect to the z-axis as shown in FIG. 4B. As noted above, all angles are measured between the air flow direction and the positive x-, y-, or z-axis.

Figure 4C:
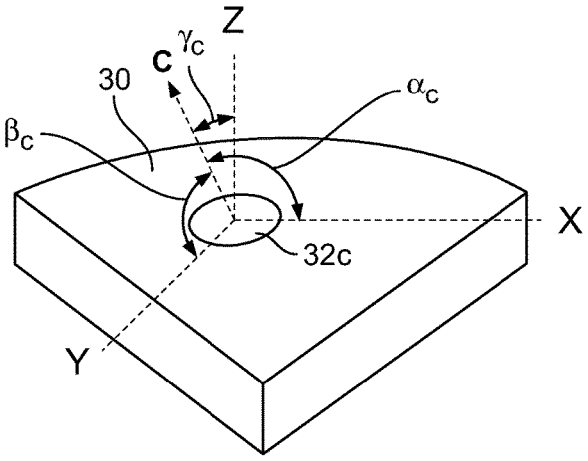
FIG. 4C illustrates an enlarged perspective view of a third channel (C) in an exemplary embodiment of the cap of FIG. 3A.

Referring to FIG. 4C, the channel 32*c* and its resultant airflow C may be formed at an angle $\alpha_C$ of between about 80 and about 110 degrees with respect to the x-axis or at an angle $\alpha_C$ of about 93 degrees with respect to the x-axis. Additionally or alternatively, the channel 32*c* and its resultant airflow C may be formed at an angle $\beta_C$ of between about 85 and about 115 degrees with respect to the y-axis or at an angle $\beta_C$ of about 98 degrees with respect to the y-axis. Still further, the channel 32*c* and its resultant airflow C may alternatively or additionally be formed at an angle $\gamma_C$ of between about 1 and about 20 degrees with respect to the z-axis or at an angle $\gamma_C$ of about 9 degrees with respect to the z-axis. As noted above, all angles are measured between the air flow direction and the positive x-, y-, or z-axis.

Figure 4D:
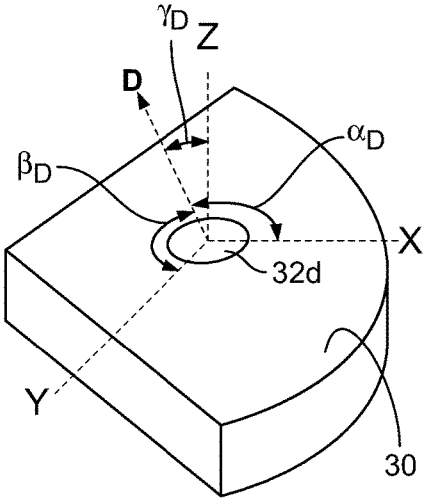
FIG. 4D illustrates an enlarged perspective view of a fourth channel (D) in an exemplary embodiment of the cap of FIG. 3A.

As seen in FIG. 4D, the channel 32*d* and its resultant airflow D may be formed at an angle $\alpha_D$ of between about 80 and about 110 degrees with respect to the x-axis or at an angle $\alpha_D$ of about 96 degrees with respect to the x-axis. Alternatively or additionally, the channel 32*d* and its resultant airflow D may be formed at an angle $\beta_D$ of between about 70 and about 100 degrees degrees with respect to the y-axis or at an angle $\beta_D$ of about 83 degrees with respect to the y-axis. Still further, the channel 32*d* and its resultant airflow D may alternatively or additionally be formed at an angle $\gamma_D$ of between about 1 and about 20 degrees with respect to the z-axis or at an angle $\gamma_D$ of about 9 degrees with respect to the z-axis. As noted above, all angles are measured between the air flow direction and the positive x-, y-, or z-axis.

Figure 5A:
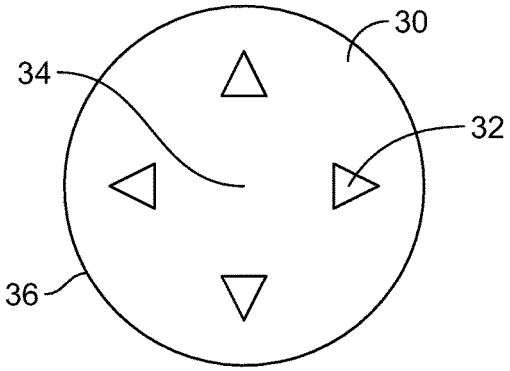
FIG. 5A is a top view of an exemplary embodiment of the cap of FIG. 2B having channels of a triangular cross-sectional shape.
Figure 5B:
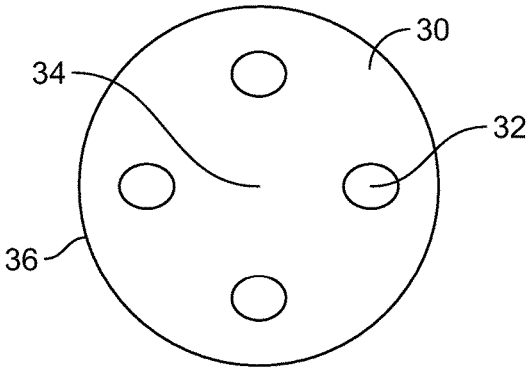
FIG. 5B is a top view of an exemplary embodiment of the cap of FIG. 2B having channels of an ovular cross-sectional shape.
Figure 5C:
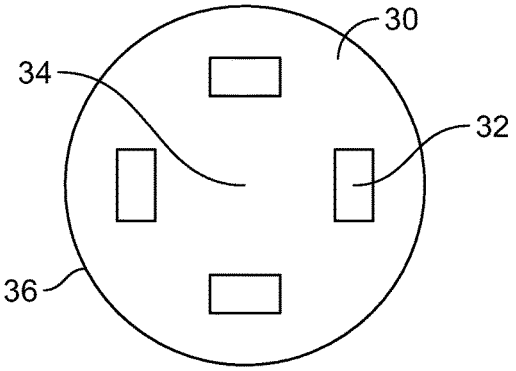
FIG. 5C is a top view of an exemplary embodiment of the cap of FIG. 2B having channels of a rectangular cross-sectional shape.
Figure 6A:
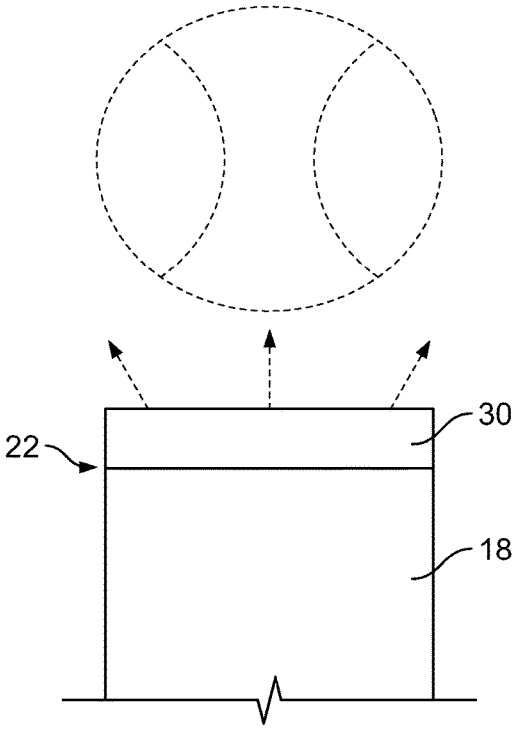
FIG. 6A illustrates a side elevation view of a further exemplary embodiment of a cap for attachment to a top portion of a hollow conduit of the ball-suspending device of FIG. 1, wherein the cap has a center channel and an outer channel.
Figure 6B:
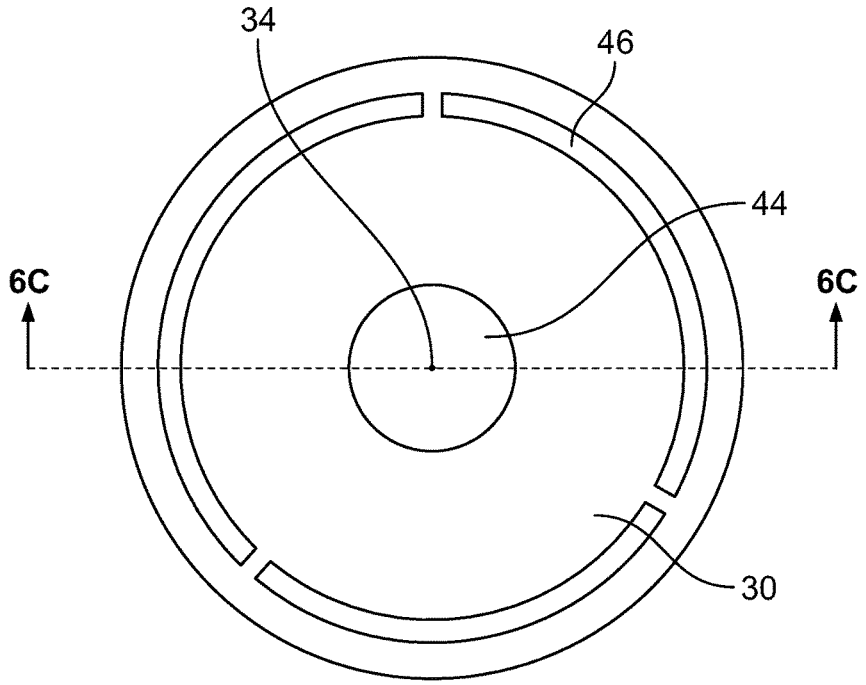
FIG. 6B is a top view of an embodiment of the cap shown in FIG. 6A.
Figure 6C:
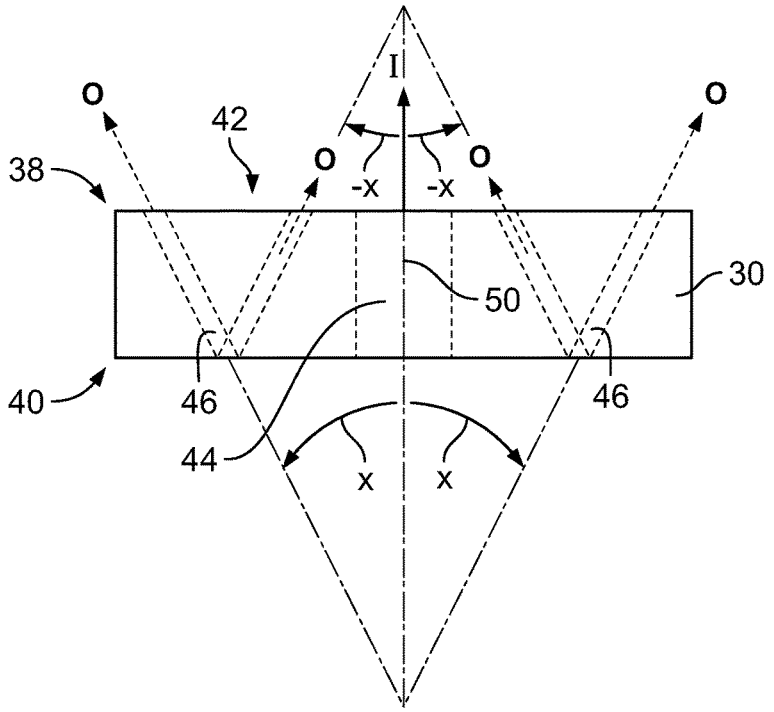
FIG. 6C is a cross-sectional view of an embodiment of the cap shown in FIG. 6B taken generally along the line of 6C-6C of FIG. 6B.
Figure 6D:
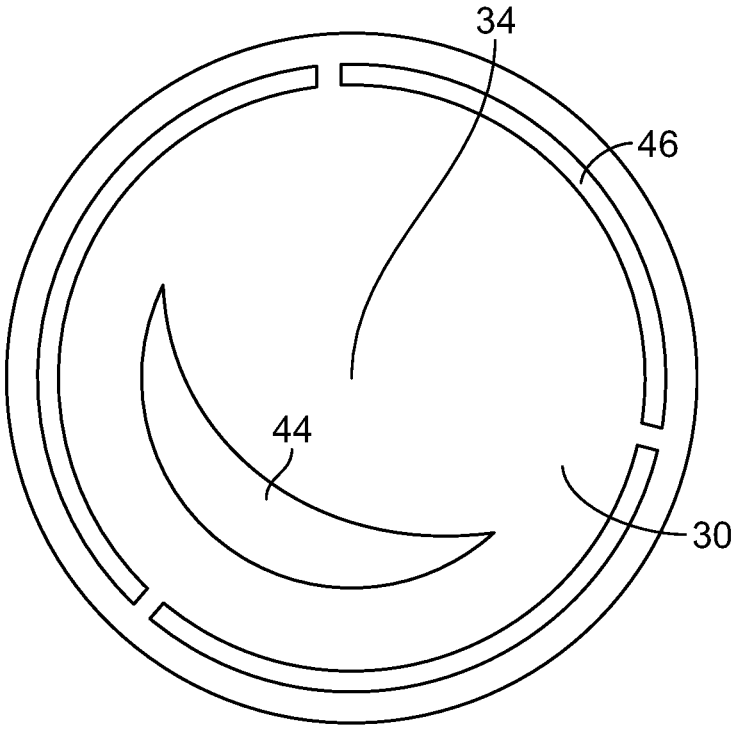
FIG. 6D is a top view of a further embodiment of the cap shown in FIG. 6A.

Additional exemplary embodiments are depicted in FIGS. 5A-5C, wherein each of the figures depicts a cap 30 having channels 32 with different cross-sectional shapes. For example, FIG. 5A illustrates an embodiment of the cap 30 having channels 32 with a triangular-shaped cross-section, FIG. 5B illustrates an embodiment of the cap 30 having channels 32 with an elliptically-shaped cross-section, and FIG. 5C illustrates an embodiment of the cap 30 having channels 32 with a rectangular-shaped cross-section. While various cross-section shapes for the channels 32 are depicted, any suitable cross-sectional shape or shapes may be utilized for the channels 32. In an exemplary embodiment, one or more channels 32 may have different cross-sectional shapes (i.e., one or more channels 32 may have a circular-cross section and one or more channels 32 may have a cross-sectional shape that is not circular). In other exemplary embodiments, the cross-sectional shape of one or more channels 32 may vary from a first end 38 to a second end 40. In still other embodiments, one or more of the channels 32 may have a diameter, width, or other dimension across the channel 32 (as seen from a top 42 of the cap 30) that varies from the first end 38 to the second end 40. In an exemplary embodiment, the diameter, width, or other dimension may decrease from the first end 38 to the second end 40 to better focus a stream of air moving through the channel 32. In other embodiments, the diameter, width, or other dimension may increase from the first end 38 to the second end 40.

Referring to FIGS. 6A-6D, in a further exemplary embodiment, the cap 30 may include a center channel 44 and an outer channel 46. In an exemplary embodiment, the center channel 44 and the outer channel 46 may be concentric with respect to center 34 of the cap 30 or the outer channel 46 may be concentric with respect to a center of the center channel 44. In an exemplary embodiment, the center channel 44 may have a diameter, width, or other dimension that varies from the first end 38 the second end 40. In another exemplary embodiment, the outer channel 46 may have a diameter, width, or other dimension that varies from the first end 38 to the second end 40. In some embodiments, the outer channel 46 may be formed of at least two channel segments or may be formed of a single, continuous channel. In this regard, an air flow through the outer channel 46 may be continuous around the center channel 44 or may be segmented. In another exemplary embodiment, the central channel 44 is formed at an angle that is perpendicular to the face 42 of the cap 30 such that a direction of air passing through the central channel 44 is directed in air flow direction I, which is also generally perpendicular to the face 42 of the cap 30. Optionally, one or more walls of the central channel 44 may be angled to direct air at an angled air flow direction. The outer channel 46 may be formed at a non-zero angle X with respect to an axis 50 that is perpendicular to the face 42 of the cap 30 such that the direction of air passing through the outer channel 46 is directed in air flow direction O. In some embodiments, the outer channel 46 is formed through the cap 30 such that the air flow direction O is pointed generally toward air flow direction I (at a negative angle, −X), and in other embodiments, the outer channel 46 is formed through the cap 30 such that air flow direction O is pointed generally away from air flow direction I (at a positive angle, +X). The angle X (either −X or +X) may be any suitable angle, for example, between about −60 degrees and about 60 degrees with respect to the axis 50, between about −45 degrees and about 45 degrees with respect to the axis 50, or between about −30 and about 30 degrees with respect to the axis 50. While the center channel 44 is depicted as being generally cylindrical in shape, the center channel 44 may have any suitable shape. Still further, the center channel 44 need not be symmetrical, nor formed through the center 34 of the cap 30. For example, referring to FIG. 6E, in one exemplary embodiment, the center channel 44 may be formed through the cap 30 with the cross-sectional shape of a crescent. In another embodiment, the center channel 44 is offset from the center 34 of the cap 30.

While particular embodiments have been disclosed herein as having particular features, it should be understood that any of the features of any of the embodiments of the present disclosure may be combined with any features of any of the other embodiments of the present disclosure.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

I claim:

1. A pneumatic ball-suspending device comprising:

a base;

a hollow post extending from the base, the post forming a batting tee;

a source of pressurized air disposed within the base and in fluid communication with the hollow post;

a cap formed at an end of the hollow post, the end being spaced away from the source of pressurized air, wherein the cap includes:

inner and outer faces that are generally perpendicular to a longitudinal axis of the hollow post, wherein the outer face is defined by x-, y-, and z-axes;

at least three channels formed through the cap between the inner and outer faces, each of the at least three channels having a longitudinal axis formed through a center of a respective one of the at least three channels, each of the at least three channels having an entrance formed through the inner face, an exit formed through the outer face, and a diameter that is less than a diameter of the hollow post;

wherein the longitudinal axis of each of the at least three channels is positioned at a non-zero and non-90 degree angle with respect to at least one of the x-, y-, or z-axes, wherein the at least three channels are not parallel to one another; and wherein the source of pressurized air forces air through the hollow post and through the at least three channels such that a ball may be supported above the air flow paths.

2. The pneumatic ball-suspending device of claim 1 including at least four channels.

3. The pneumatic ball-suspending device of claim 2, wherein the at least four channels are equidistant from the longitudinal axis of the hollow post, which runs through a center of the cap.

4. The pneumatic ball-suspending device of claim 2, wherein the at least four channels are not equidistant from the longitudinal axis of the hollow post.

5. The pneumatic ball-suspending device of claim 1, wherein the cap is integral with the hollow post.

6. The pneumatic ball-suspending device of claim 1, wherein the cap is removably attached to the end of the hollow post.

7. The pneumatic ball-suspending device of claim 2, wherein the longitudinal axis of each of the at least three channels is angled with respect to at least two of the x-, y-, or z-axes.

8. The pneumatic ball-suspending device of claim 2, wherein:

a first longitudinal axis of a first channel of the at least four channels is angled about 92 degrees with respect to the x-axis, about 78 degrees with respect to the y-axis, and about 12 degrees with respect to the z-axis;

a second longitudinal axis of a second channel of the at least four channels is angled about 79 degrees with respect to the x-axis, about 89 degrees with respect to the y-axis, and about 11 degrees with respect to the z-axis;

a third longitudinal axis of a third channel of the at least four channels is angled about 93 degrees with respect to the x-axis, about 98 degrees with respect to the y-axis, and about 9 degrees with respect to the z-axis; and a fourth longitudinal axis of a fourth channel of the at least four channels is angled about 96 degrees with respect to the x-axis, about 83 degrees with respect to the y-axis, and about 9 degrees with respect to the z-axis.

9. The pneumatic ball-suspending device of claim 1, wherein each of the at least three channels has a shape that is defined by a cross-section of the respective one of the at least three channels perpendicular to the longitudinal axis of the respective one of the at least three channels, and wherein the shape is a circle, oval, ellipse, crescent, triangle, curvilinear triangle, rectangle, square, rhombus, parallelogram, trapezoid, trapezium, kite, pentagon, hexagon, heptagon, octagon, nonagon, or decagon.

10. A pneumatic ball-suspending device comprising:

a base;

a hollow post extending from the base, the hollow post forming a batting tee:

a source of pressurized air disposed within the base and in fluid communication with the hollow post:

a cap formed at an end of the hollow post the end being spaced away from the source of pressurized air, and wherein the cap includes:

inner and outer faces that are generally perpendicular to a longitudinal axis of the hollow post:

a central channel formed through the cap between the inner and outer faces, wherein the central channel is coincident with the longitudinal axis of the hollow post, an outer channel formed through the cap between the inner and outer surfaces of the cap, wherein the outer channel is and spaced outwardly from the central channel and the outer channel is concentric with the central channel and includes inner and outer walls that are spaced from one another to form a channel configured for air flow therethrough;

wherein the longitudinal axis of the central channel defines an airflow path out of the central channel that is generally perpendicular to a face of the cap; and wherein the source of pressurized air forces air through the central and outer channels such that air flows through each of the central and outer channels to support a ball.

11. The pneumatic ball-suspending device of claim 10, wherein the inner and outer walls of the outer channel are parallel to one another.

12. The pneumatic ball-suspending device of claim 10, wherein the inner and outer walls are cylindrical and the central channel is cylindrical.

13. The pneumatic ball-suspending device of claim 10, wherein an air flow out of the outer channel is disposed at a non-zero angle with respect to the longitudinal axis of the central channel along at least one segment of the outer channel.

14. The pneumatic ball-suspending device of claim 13, wherein the air flow out of the outer channel is disposed at a non-zero angle with respect to the longitudinal axis of the central channel along an entirety of the outer channel.

15. The pneumatic ball-suspending device of claim 10, wherein an air flow out of the outer channel is disposed at an angle of between about 60 and about −60 degrees with respect to the longitudinal axis of the central channel.

16. The pneumatic ball-suspending device of claim 10, wherein the outer channel is formed of intermittent channel segments.

17. The pneumatic ball-suspending device of claim 10, wherein the central channel has a shape that is defined by a cross-section of the channel perpendicular to the longitudinal axis, and wherein the shape is a circle, oval, ellipse, crescent, triangle, curvilinear triangle, rectangle, square, rhombus, parallelogram, trapezoid, trapezium, kite, pentagon, hexagon, heptagon, octagon, nonagon, or decagon.

* * * * *